US009439822B1

(12) United States Patent
Davy et al.

(10) Patent No.: US 9,439,822 B1
(45) Date of Patent: Sep. 13, 2016

(54) LIFTING ASSEMBLY

(71) Applicants: Gloria Davy, Carson, WA (US); Anita Davy, Carson, WA (US)

(72) Inventors: Gloria Davy, Carson, WA (US); Anita Davy, Carson, WA (US)

( * ) Notice: Subject to any disclaimer, the term of this patent is extended or adjusted under 35 U.S.C. 154(b) by 0 days.

(21) Appl. No.: 14/656,913

(22) Filed: Mar. 13, 2015

(51) Int. Cl.
*A61G 7/10* (2006.01)
*A61G 5/14* (2006.01)

(52) U.S. Cl.
CPC ..... *A61G 7/1021* (2013.01); *A61G 5/14* (2013.01); *A61G 7/1073* (2013.01); *A61G 7/1013* (2013.01)

(58) Field of Classification Search
CPC .... A61G 7/10; A61G 7/1013; A61G 7/1021; A61G 5/14; A47G 27/081; A47G 27/082; B63B 35/76; B63B 35/74; B63B 7/08; B63C 9/08; B63C 9/082; B63C 9/04; B63C 2009/042
USPC ..... 5/654, 655.3, 652, 83.1, 81.1 R; 441/81, 441/80, 129–131
See application file for complete search history.

(56) References Cited

U.S. PATENT DOCUMENTS 34,982 A 4/1862 Race
35,497 A 6/1862 Adair
3,331,087 A * 7/1967 Barlow ..... A61G 7/1009 5/655.3
3,479,087 A 11/1969 Burkw
3,729,754 A * 5/1973 Hastings ..... A47C 27/081 137/223
3,748,672 A * 7/1973 Patrick ..... B63B 35/76 441/131
4,005,498 A * 2/1977 Starr ..... A61G 7/1009 5/81.1 R
4,629,162 A 12/1986 Porche
4,905,329 A 3/1990 Heilner
5,046,205 A * 9/1991 Garcia ..... A47C 7/021 4/456
5,079,785 A * 1/1992 Garcia ..... A47C 7/021 4/456
5,154,649 A * 10/1992 Pender ..... A47D 13/083 5/490
5,190,194 A * 3/1993 Rosner ..... A47G 23/0225 224/0.5
D334,862 S 4/1993 Harris
5,297,978 A * 3/1994 Ramsey ..... B63B 7/08 114/345
5,333,336 A * 8/1994 Langsam ..... A47C 3/38 297/DIG. 3
5,361,433 A * 11/1994 Vanzant ..... A61G 5/14 254/93 HP
5,375,910 A * 12/1994 Murphy ..... A61G 5/14 297/256.13
D359,191 S * 6/1995 Whitebread ..... 297/DIG. 10
5,474,481 A * 12/1995 Ramsey ..... B63B 7/08 114/345
5,505,518 A 4/1996 Pike (Continued)

FOREIGN PATENT DOCUMENTS

WO WO2008149083 12/2008

*Primary Examiner* — Robert G Santos

(57) ABSTRACT

A lifting assembly includes a pillow that may be positioned between a user and a support surface after the user has fallen onto the support surface. The pillow may support a weight ranging between approximately 250 pounds and 500 pounds. A valve is attached to the pillow and a pump is selectively attached to the valve. The pump selectively urges air into the pillow thereby facilitating the pump to inflate the pillow. The pillow lifts the user upwardly from the support surface as the pillow is inflated thereby facilitating the user to stand up. The pillow reaches a height ranging between approximately 18 inches and 25 inches with respect to the support surface when the pillow is inflated.

4 Claims, 3 Drawing Sheets

(56) References Cited

U.S. PATENT DOCUMENTS 5,742,957 A * 4/1998 Vanzant ..... A61G 5/14 297/DIG. 10
5,918,936 A * 7/1999 Murphy ..... A61G 5/14 297/313
5,988,747 A * 11/1999 Jeans ..... A61G 5/14 297/256.13
5,996,133 A * 12/1999 Fletcher ..... A61G 7/1007 4/237
6,113,188 A 9/2000 Stewart et al.
7,028,350 B1 * 4/2006 Davis ..... A61G 7/1021 297/452.41
7,168,115 B2 * 1/2007 Davis ..... A61G 7/1021 5/655.3
8,037,560 B2 * 10/2011 Goldner ..... A47C 7/021 297/DIG. 10
2006/0123550 A1 * 6/2006 Davis ..... A61G 7/1021 5/655.3
2007/0028388 A1 * 2/2007 Fletcher ..... A61G 7/1021 5/655.3
2010/0028388 A1 * 2/2010 Gibson ..... A61K 9/703 424/400
2010/0132121 A1 * 6/2010 Chao ..... F16K 15/20 5/655.3
2010/0170037 A1 7/2010 Fletcher et al.
2010/0199424 A1 * 8/2010 Goldner ..... A47C 7/021 5/83.1
2013/0055504 A1 3/2013 Peash et al.

* cited by examiner

LIFTING ASSEMBLY

BACKGROUND OF THE DISCLOSURE

Field of the Disclosure

The disclosure relates to lifting devices and more particularly pertains to a new lifting device for helping an individual stand up after the individual has fallen.

SUMMARY OF THE DISCLOSURE

An embodiment of the disclosure meets the needs presented above by generally comprising a pillow that may be positioned between a user and a support surface after the user has fallen onto the support surface. The pillow may support a weight ranging between approximately 250 pounds and 500 pounds. A valve is attached to the pillow and a pump is selectively attached to the valve. The pump selectively urges air into the pillow thereby facilitating the pump to inflate the pillow. The pillow lifts the user upwardly from the support surface as the pillow is inflated thereby facilitating the user to stand up. The pillow reaches a height ranging between approximately 18 inches and 25 inches with respect to the support surface when the pillow is inflated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
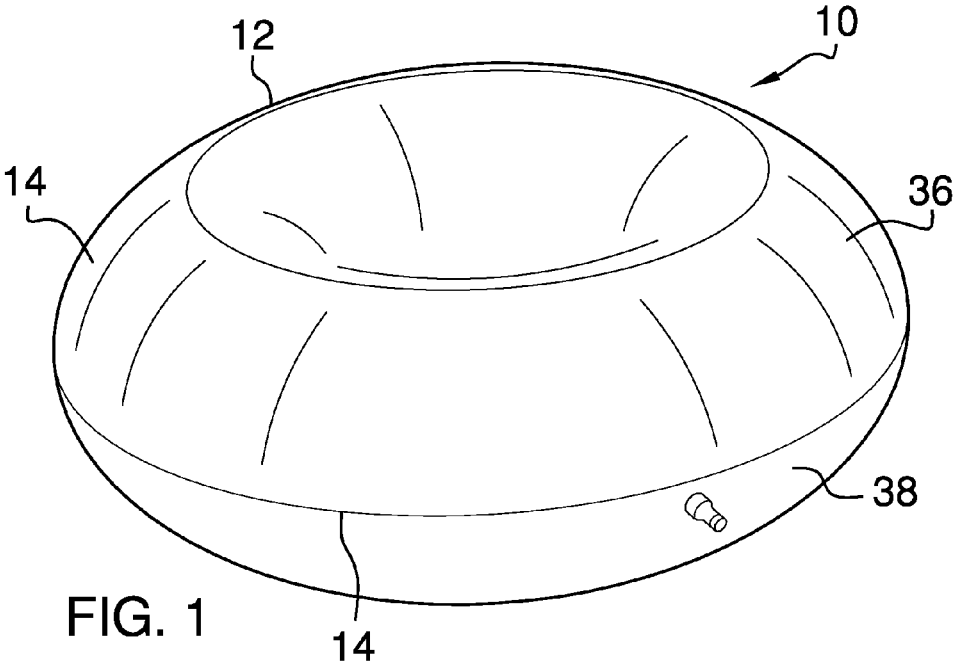
FIG. 1 is a perspective view of a lifting assembly in an inflated state according to an embodiment of the disclosure.
Figure 2:
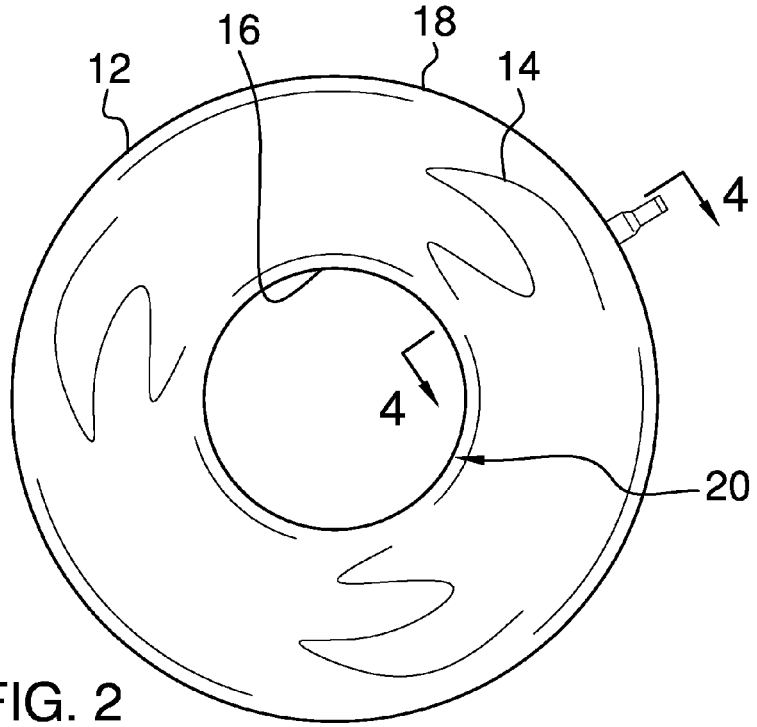
FIG. 2 is a top view of an embodiment of the disclosure.
Figure 3:
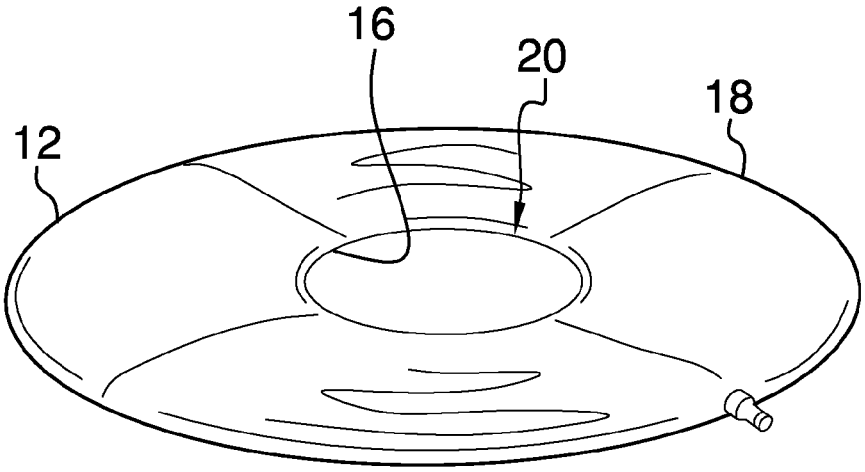
FIG. 3 is a perspective view of an embodiment of the disclosure in a deflated state.
Figure 4:
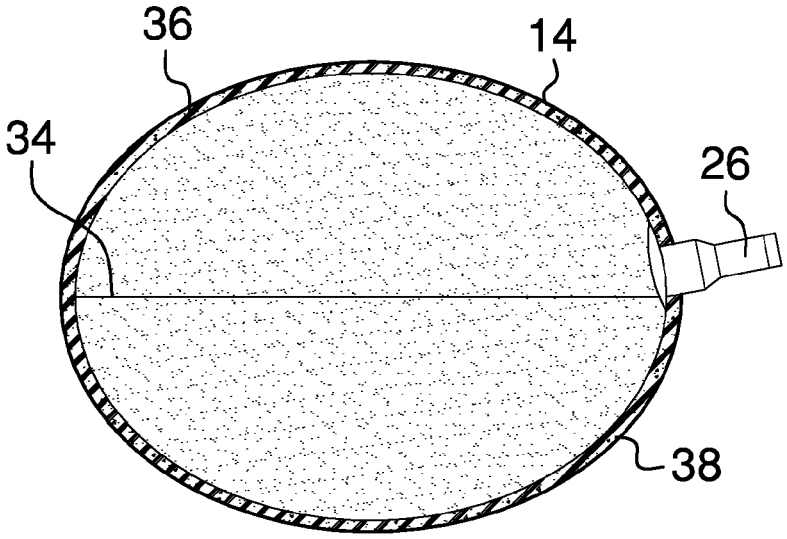
FIG. 4 is a cross sectional view taken along line 4-4 of FIG. 2 of an embodiment of the disclosure.
Figure 5:
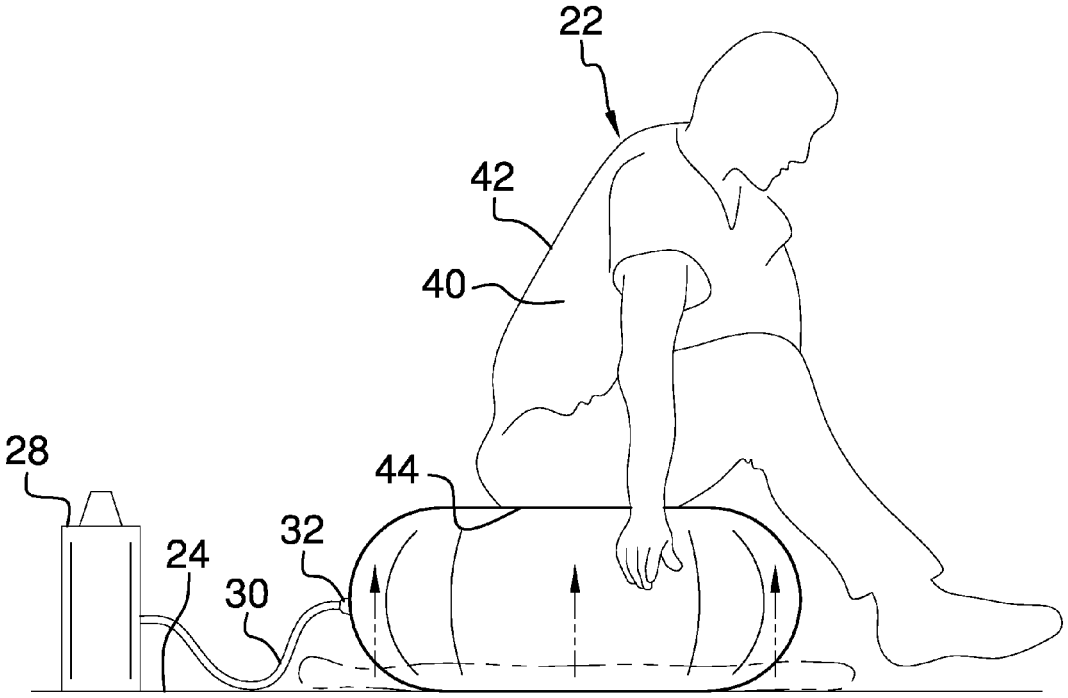
FIG. 5 is a perspective in-use view of an embodiment of the disclosure.

With reference now to the drawings, and in particular to FIGS. 1 through 5 thereof, a new lifting device embodying the principles and concepts of an embodiment of the disclosure and generally designated by the reference numeral 10 will be described.

A pillow 12 is provided that has an outer wall 14 and the outer wall 14 has an inner side 16 and an outer side 18. The inner side 16 is curvilinear with respect to the outer side 18 such that the pillow 12 has a donut shape and the outer wall

14 is continuous to define an interior of the pillow 12. The inner side 16 of the pillow 12 defines an interior opening 20 of the pillow 12. The interior of the pillow 12 is fluidly discrete from a surrounding environment. The pillow 12 may be positioned between a user 22 and a support surface 24 after the user 22 has fallen onto the support surface 24. The support surface 24 may be a floor or the like. The pillow 12 may be comprised of a resilient material such as poly vinyl chloride thereby facilitating the pillow 12 to support a weight ranging between approximately 250 pounds and 500 pounds.

A valve 26 is attached to the pillow 12 and the valve 26 is positioned on the outer side 18 of the outer wall 14. The valve 26 extends through the outer wall 14 such that the valve 26 is in fluid communication with the interior of the pillow 12. The valve 26 may be an air valve or the like capable of selectively restricting a flow of air outwardly from the interior of the pillow 12.

A pump 28 is provided and the pump 28 has a hose 30 attached thereto. The hose 30 has a distal end 32 with respect to the pump 28 and the distal end 32 is removably attached to the valve 26. The pump 28 selectively urges air into the pillow 12 thereby facilitating the pump 28 to inflate the pillow 12. The pump 28 may be an air pump or the like. The pillow 12 lifts the user 22 upwardly from the support surface 24 as the pillow 12 is inflated thereby facilitating the user 22 to stand up. The pillow 12 reaches a height ranging between approximately 18 inches and 25 inches with respect to the support surface 24 when the pillow 12 is inflated.

An elastic member 34 is attached to the outer wall 14 and the elastic member 34 extends along the outer side 18. The elastic member 34 divides the outer side 18 into an upper half 36 and a lower half 38. The elastic member 34 allows the upper half 36 to lie flat on the lower half 38 when the pillow 12 is deflated thereby facilitating the pillow 12 to be stored when the pillow 12 is not in use.

In use, the pillow 12 is placed on the support surface 24 while the pillow 12 is deflated such that the pillow 12 is located near the user 22 after the user 22 has fallen. The user 22 is rolled onto the user's side 40 and the pillow 12 is moved to be placed next to the user 22. The user 22 is rolled onto the user's back 42 such that the user's buttocks 44 are positioned within the interior opening 20 in the pillow 12. The hose 30 is attached to the valve 26 and the pump 28 is used to inflate the pillow 12. The pillow 12 raises the user 22 upwardly from the support surface 24 a distance sufficient to allow the user 22 to place the user's feet 46 beneath the user 22, thereby facilitating the user 22 to stand up.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A lifting assembly configured to assist an individual to stand up after the individual has fallen, said assembly comprising:

a pillow, said pillow being configured to be positioned between a user and a support surface after the user has fallen onto the support surface, said pillow being configured to support a weight ranging between approximately 250 pounds and 500 pounds;

a valve attached to said pillow;

a pump, said pump being selectively attached to said valve, said pump selectively urging air into said pillow thereby facilitating said pump to inflate said pillow, said pillow being configured to lift the user upwardly from the support surface as said pillow is inflated thereby facilitating the user to stand up, said pillow reaching a height ranging between approximately 18 inches and 25 inches with respect to the support surface when said pillow is inflated;

said pillow having an outer wall, said outer wall having an inner side and an outer side, said inner side being curvilinear with respect to said outer side such that said pillow has a donut shape, said outer wall being continuous to define an interior of said pillow, said interior of said pillow being fluidly discrete from a surrounding environment; and an elastic member attached to said outer wall, said elastic member extending along said outer side, said elastic member dividing said outer wall into an upper half and a lower half.

2. The assembly according to claim 1, wherein said valve is positioned on said outer side of said outer wall, said valve extending through said outer wall such that said valve is in fluid communication with said interior of said pillow.

3. The assembly according to claim 1, wherein said pump has a hose attached thereto, said hose having a distal end with respect to said pump, said distal end being removably attached to said valve.

4. A lifting assembly configured to assist an individual to stand up after the individual has fallen, said assembly comprising:

a pillow having an outer wall, said outer wall having an inner side and an outer side, said inner side being curvilinear with respect to said outer side such that said pillow has a donut shape, said outer wall being continuous to define an interior of said pillow, said interior of said pillow being fluidly discrete from a surrounding environment, said pillow being configured to be positioned between a user and a support surface after the user has fallen onto the support surface, said pillow being configured to support a weight ranging between approximately 250 pounds and 350 pounds;

an elastic member attached to said outer wall, said elastic member extending along said outer side, said elastic member dividing said outer wall into an upper half and a lower half;

a valve attached to said pillow, said valve being positioned on said outer side of said outer wall, said valve extending through said outer wall such that said valve is in fluid communication with said interior of said pillow; and a pump, said pump having a hose attached thereto, said hose having a distal end with respect to said pump, said distal end being removably attached to said valve, said pump selectively urging air into said pillow thereby facilitating said pump to inflate said pillow, said pillow being configured to lift the user upwardly from the support surface as said pillow is inflated thereby facilitating the user to stand up, said pillow reaching a height ranging between approximately 18 inches and 25 inches with respect to the support surface when said pillow is inflated.

* * * * *